US006099996A

United States Patent [19]

Yanus et al.

[11] Patent Number: 6,099,996

[45] Date of Patent: Aug. 8, 2000

[54] ELECTROPHOTOGRAPHIC IMAGING MEMBER WITH AN IMPROVED CHARGE TRANSPORT LAYER

[75] Inventors: John F. Yanus, Webster; Damodar M. Pai, Fairport; Timothy J. Fuller, Pittsford; Dale S. Renfer, Webster; William W. Limburg, Penfield, all of N.Y.

[73] Assignee: Xerox Corporation, Stamford, Conn.

[21] Appl. No.: 09/363,198

[22] Filed: Jul. 29, 1999

Related U.S. Application Data

[63] Continuation-in-part of application No. 09/048,940, Mar. 26, 1998, abandoned.

[51] Int. Cl.[7] ..... G03G 5/047

[52] U.S. Cl. ..... 430/58.8; 430/58.65; 430/58.75; 430/133

[58] Field of Search ..... 430/58.75, 58.8, 430/133, 58.65

[56] References Cited

U.S. PATENT DOCUMENTS

| | | | |
|---|---|---|---|
| 4,983,481 | 1/1991 | Yu | 430/59 |
| 5,167,987 | 12/1992 | Yu | 427/171 |
| 5,413,810 | 5/1995 | Mastalski | 427/171 |
| 5,698,359 | 12/1997 | Yanus et al. | 430/132 |
| 5,728,498 | 3/1998 | Yanus et al. | 430/59 |
| 6,025,102 | 2/2000 | Pai et al. | 430/58.8 |

*Primary Examiner*—Christopher D. Rodee

[57] ABSTRACT

A flexible electrophotographic imaging member comprising a substrate and at least one imaging layer comprising a first charge transport material, free of long chain alkyl ester groups or long chain alkyl carboxyl groups, and a small amount of a different second charge transporting material containing only one long chain alkyl ester group dissolved or molecularly dispersed in a film forming binder, the at least one imaging layer having been formed by drying a coating comprising a solution of the first transporting material and second charge transporting material and the film forming polymer binder in a mixture of a low volatility solvent and a high volatility solvent. A method for fabricating this imaging member is also disclosed.

14 Claims, No Drawings

ELECTROPHOTOGRAPHIC IMAGING MEMBER WITH AN IMPROVED CHARGE TRANSPORT LAYER

This is a continuation-in-part application of application Ser. No. 09/048,940 entitled "ELECTROPHOTOGRAPHIC IMAGING MEMBER WITH AN IMPROVED CHARGE TRANSPORT LAYER", filed in the names of J. F. Yanus et al. on Mar. 26, 1998 now abandoned.

BACKGROUND OF THE INVENTION

This invention relates in general to electrostatography and, more specifically, to an electrostatographic imaging member having a charge transport layer comprising a mixture of a first hole transporting material and a different second hole transporting material containing only one long chain alkyl ester group.

In the art of xerography, a xerographic plate comprising a photoconductive insulating layer is imaged by first uniformly depositing a uniform electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electrostatically attractable marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography may comprise at least two electrically operative layers. This type of composite photoconductive layer is illustrated in U.S. Pat. No. 4,265,990. A photosensitive member is described in this patent as having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive materials exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous dispersions of conductive material in binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and therefore developed with finely developed electrostatically attractable marking particles.

If a thin, flat, biaxially oriented polyethylene terephthalate (e.g. 3 mil thick PET) web is solution coated with a thick imaging layer comprised of 50 percent by weight polycarbonate (e.g. Makrolon) and 50 percent by weight aromatic diamine, the web tends to curl. The curling begins when the coating solvent evaporates, due to the dimensional contraction of the applied coating from the point in time when the applied charge transport coating solidifies and adheres to the underlying surface. Once this solidification and adhesion point is reached, further evaporation of the coating solvent causes continued shrinking of the applied coating layer due to the volume contraction. Since the polyethylene terephthalate substrate does not undergo any dimensional changes, the continued shrinkage of the charge transport layer coating causes the edges of the coated web to curl toward the coated side of the substrate. This shrinking occurs isotropically, i.e., three-dimensionally. In other words, from the point in time when the applied coating has reached a solid state and is anchored at the interface with the underlying support layer, continued shrinking of the applied coating causes dimensional decreases in the applied coating which in turn builds up internal tension stress and, therefore, forces the entire coated structure to curl toward the dry applied charge transport layer coating. Internal tension is undesirable because it causes distortion of the imaging surface of the photoconductive member. This can cause different segments of the photoreceptor surface to be located at different distances from charging devices, developer applicators, toner image receiving members and the like during the electrophotographic imaging process, thereby adversely affecting the quality of the ultimate developed images. For example, non-uniform charging distances can be manifested as variations in high background deposits during development of electrostatic latent images. A free standing sample of such an imaging member can spontaneously form a roll as small as 3.8 cm in diameter and requires considerable tension to flatten the imaging member against the surface of a separate supporting device. Where the supporting device comprises a large flat area for full frame flash exposure, the imaging member may tear before sufficient flatness can be achieved. Moreover, constant flexing of multilayered photoreceptor belts during cycling can cause stress cracks to form due to fatigue. These cracks print out on the final electrophotographic copy. Premature failure due to fatigue prohibits use of these belts in designs utilizing small support roller sizes (e.g. 19 mm or smaller) which are desirable for effective auto paper stripping. Coatings may be applied to the side of the supporting substrate opposite the electrically active layer or layers to counteract the tendency to curl. However, such an anticurl coating requires an additional coating step on the side of the substrate opposite from the side where all the other coatings are applied. This additional coating operation normally requires that a substrate web be unrolled an additional time merely to apply the anticurl layer. Also, many of the solvents utilized to apply the anticurl layer require additional steps and solvent recovery equipment to minimize solvent pollution of the atmosphere. Further, equipment required to apply the anticurl coating must be cleaned with solvent and refurbished from time to time. The additional coating operations raise the cost of the photoreceptor, increase manufacturing time, decrease production throughput, and increase the likelihood that the photoreceptor will be damaged by the additional handling. In addition, the anticurl backing layer can form bubbles during application which requires scrapping of that portion of the photoreceptor containing the bubbles. This in turn reduces total manufacturing yield. Also, difficulties have been encountered with these anticurl coatings. For example, photoreceptor curl can sometimes still be encountered due to a decrease in anticurl layer thickness resulting from wear in as few as 1,500 imaging cycles when the photoreceptor belt is exposed to stressful operating conditions of high temperature and high humidity. The curling of the photoreceptor is inherently caused by an imbalance of internal stresses between the electrically active layer and the anticurl coating. This can promote dynamic fatigue cracking, thereby shortening the mechanical life of the photoreceptor. Wear of the anticurl coating can also result in distortions which resemble ripples. These ripples are the most serious photoreceptor related problem in advanced precision imaging machines that demand precise tolerances. When ripples are present, it again results in different segments of the imaging surface of the photoconductive member being located at different distances from charging devices, developer applicators, toner image receiving members and the like during the electrophotographic imaging process thereby adversely affecting the quality of the ultimate developed images. For example, non-uniform charging distances can be manifested as variations in high background deposits during development of electrostatic latent images. It is theorized that the anticurl backing layer is subjected to a highly abrasive environment including drive rollers, guiding rollers and especially stationary skid plates. In this environment, it wears rapidly during extended image cycling. This wear is non-uniform and leads to the distortions which resemble ripples. The wear process also produces debris which can form undesirable deposits on sensitive optics, corotron wires and the like. The anticurl backing layer is usually composed of material that is less wear resistant than the adjacent substrate layer, hence less debris would be generated in a photoreceptor device not needing an anticurl layer. Further, the anticurl coatings occasionally separate from the substrate during extended machine cycling and render the photoconductive imaging member unacceptable for forming quality images. Anticurl layers will also occasionally delaminate due to poor adhesion to the supporting substrate. Moreover, in electrostatographic imaging systems where transparency of the substrate and anticurl layer are necessary for rear exposure erase to activating electromagnetic radiation, any reduction of transparency due to the presence of an anticurl layer will cause a reduction in performance of the photoconductive imaging member. Although the reduction in transparency may in some cases be compensated for by increasing the intensity of the electromagnetic radiation, such an increase is generally undesirable due to the amount of heat generated as well as the greater costs necessary to achieve higher intensity.

Another property of significance in multilayer devices is the charge carrier mobility in the transport layer. Charge carrier mobilities determine the velocities at which the photoinjected carriers transit the transport layer. To achieve maximum discharge or sensitivity for a fixed exposure, the photoinjected carriers must transit the transport layer before the imagewise exposed region of the photoreceptor arrives at the development station. To the extent the carriers are still in transit when the exposed segment of the photoreceptor arrives at the development station, the discharge is reduced and hence the contrast potentials available for development are also reduced. For greater charge carrier mobility capabilities, it is normally necessary to increase the concentration of the active molecule transport compound dissolved or molecularly dispersed in the binder. Phase separation or crystallization sets an upper limit to the concentration of the transport molecules that can be dispersed in a binder. One way of increasing the solubility limit of the transport molecule is to attach long alkyl groups on to the transport molecules. However, these alkyl groups are "inactive" and do not transport charge. For a given concentration of the transport molecules, these side chains actually reduce the charge carrier mobilities. A second factor that reduces the charge carrier mobilities is the dipole content of the charge transport molecules, the side groups of the charge transport molecules, and the binder in which the molecules are dispersed. One prior art approach for reducing the curl (see U.S. Pat. No. 5,728,498 referenced below) involves an imaging member comprising hole transporting material containing at least two long chain alkyl carboxylate groups dissolved or molecularly dispersed in a film forming binder. The prior art suggests the use of these molecules containing long chain alkyl carboxylate groups dispersed in a binder or in combination with a conventional hole transport molecule. However, when in combination with the conventional transport molecule, the concentration of the molecule with the long chain alkyl carboxylate groups has to be considerably larger than 15 percent by weight based on the total weight of the layer in order to eliminate curl. Although curl is eliminated and these devices can be used in electrophotography, high speed electrophotography requires high charge carrier mobilities. Use of a large concentration of transporting material containing at least two long chain alkyl carboxylate groups results in a drop in mobilities because of the "inactive" long chains required to reduce curl as well as the dipole content of these long alkyl carboxylate groups.

Another shortcoming of the prior art is the propensity for deletion. Deletion requires special engineering solutions such as optimized airflows in and around corotrons. Reprographic machines containing multilayered organic photoconductors often employ corotrons or scorotrons to charge the photoconductor prior to imagewise exposure. During the operating lifetime of these photoconductors, they are subjected to corona effluents which include ozone, various oxides of nitrogen etc. It is believed that some of these oxides of nitrogen are converted to nitric acid in the presence of water molecules present in the ambient operating atmosphere. The top surface of the photoconductor is exposed to the nitric acid during operation of the machine and the photoconductor molecules at the very top surface of the transport layer are converted to what is believed to be the nitrated species of the molecules and these could form electrically conductive film. However, during operation of the machine, the cleaning subsystem continuously removes (by wear) a region of the top surface thereby preventing accumulation of the conductive species. Unfortunately, such is not the case when the machine is not operating (i.e., in the idle mode) between two large copy runs. During the idle mode between long copy runs, for example, runs for a 1000 copies, a specific segment of the photoreceptor comes to rest (parked) beneath the corotron that had been in operation during the long copy run. Although the high voltage to the corotron is turned off during the time period when the photoreceptor is parked, some effluents (i.e., nitric acid etc.) continue to be emitted from the corotron shield, corotron housing, etc. This effluent emission is concentrated in the region of the stationary photoreceptor parked directly underneath the corotron. The effluents render the surface region of the photoreceptor electrically conductive. When machine operation is resumed for the next copy run, a loss of resolution, and even deletion, is observed in the affected region of the photoreceptor. Thus, the corona induced changes primarily occur in the surface region of the charge transport layer. The problem of deletion may also occur as a loss of resolution during an extended copying run. The onset of loss of resolution depends on the type and number of corotrons employed and the airflow configuration within the machines. Although one of the prior art (see U.S. Pat. No. 6,025,102 referenced below) dealing with curl elimination accomplished curl elimination without sacrificing charge carrier mobility, it did not improve resistance to corona induced deletion.

INFORMATION DISCLOSURE STATEMENT

U.S. Pat. No. 5,728,498 to Yanus et al. issued Mar. 17, 1998—A flexible electrophotographic imaging member is described including a supporting substrate coated with at least one imaging layer comprising hole transporting material containing at least two long chain alkyl carboxylate groups dissolved or molecularly dispersed in a film forming binder.

U.S. Pat. No. 5,413,810 to Mastalski, issued May 9, 1995,—A seamless belt is disclosed fabricated by application of a coating to an endless substrate. The substrate is elastically stretched over a hollow cylindrical elongated support mandrel. The mandrel is formed of a porous material. Fluid is applied under pressure through the mandrel to form a layer of fluid between the outer surface of the mandrel and the inner surface of the substrate. The flow of fluid is manipulated to axially displace and to rotate the substrate on the outer surface of the mandrel. The flow of fluid is manipulated to orient a selected portion of the surface of the substrate to an angle to a direction of application of a coating. The temperature of fluid is manipulated to assist in substrate temperature control at steps of the coating and drying process.

U.S. Pat. No. 5,698,359 to J. Yanus et al., issued Dec. 16, 1997—A process is disclosed for fabricating an electrophotographic imaging member including providing a supporting substrate, forming a charge generating layer on the substrate, applying a coating composition to the charge generating layer, the coating composition including a film forming charge transporting polymer dissolved in methylene chloride and a solvent selected from the group consisting of 1,2 dichloroethane, 1,1,2 trichloroethane or mixtures thereof, the charge transporting polymer having a backbone comprising active arylamine moieties along which charge is transported, and drying the coating to form a charge transporting layer.

U.S. Pat. No. 5,167,987 to Yu issued—A process for fabricating an electrostatographic imaging member is disclosed comprising providing a flexible substrate comprising a solid thermoplastic polymer, forming an imaging layer coating comprising a film forming polymer on the substrate, heating the coating, cooling the coating, and applying sufficient predetermined biaxial tensions to the substrate while the imaging layer coating is at a temperature greater than the glass transition temperature of the imaging layer coating to substantially compensate for all dimensional thermal contraction mismatches between the substrate and the imaging layer coating during cooling of the imaging layer coating and the substrate, removing application of the biaxial tension to the substrate, and cooling the substrate whereby the final hardened and cooled imaging layer coating and substrate are substantially free of stress and strain.

U.S. Pat. No. 4,983,481 to Yu, issued Jan. 8, 1991—An imaging member without an anticurl layer is disclosed having improved resistance to curling. The imaging member comprises a flexible supporting substrate layer, an electrically conductive layer, an optional adhesive layer, a charge generator layer and a charge transport layer, the supporting layer having a thermal contraction coefficient substantially identical to the thermal contraction coefficient of the charge transport layer.

CROSS REFERENCE TO RELATED COPENDING APPLICATIONS

U.S. Pat. No. 6,025,102 to Pai et al., filed Aug. 19, 1997, entitled Electrophotographic Imaging Member,—A flexible electrophotographic imaging member including a supporting substrate coated with at least one imaging layer comprising charge transport material free of long chain alkyl carboxylate groups and a small amount of a different second hole transporting material containing at least two long chain alkyl carboxylate groups dissolved or molecularly dispersed in a film forming binder and coated from a mixture of solvents containing low boiling component and a small concentration of high boiling solvent. Preferably, the flexible electrophotographic imaging member is free of an anticurl backing layer, the imaging member comprising a supporting substrate uncoated on one side and coated on the opposite side with at least a charge generating layer and a charge transport layer containing comprising a first charge transport material and a small amount of a different second hole transporting material containing at least two long chain alkyl carboxylate groups dissolved or molecularly dispersed in a film forming binder and coated from a mixture of solvents containing low boiling component and a small concentration of high boiling solvent.

U.S. Pat. No. 5,863,685 to DeFeo et al., filed Aug. 19, 1997, entitled Electrophotographic Imaging Member Having An Improved Charge Transport Layer,—A flexible electrophotographic imaging member including a supporting substrate coated with at least one imaging layer including hole transporting material containing a hole transporting molecule dissolved or molecularly dispersed in a film forming binder and coated from a mixture of solvents including a low point boiling solvent and a small concentration of high boiling point solvent. Preferably, the flexible electrophotographic imaging member is free of an anticurl backing layer, the imaging member including a supporting substrate uncoated on one side and coated on the opposite side with at least a charge generating layer and a charge transport layer containing hole transporting material dissolved or molecularly dispersed in a film forming binder and coated from a mixture of solvents containing a low boiling point solvent and a small concentration of high boiling point solvent.

Some of the inventions and applications of the prior art addressing the solving of the curl problem without using an anticurl back coating, do so by creating a loss of charge carrier mobilities in the process of solving the anti curl problem. The reduction in charge carrier mobilities limits the application of these devices to low throughput applications in which the surface velocity of the photoconductor medium is low and therefore the print output per minute is also low.

Other inventions and applications of the prior art addressed to solving the curl problem and not adversely impacting the charge carrier mobilities, do not solve the deletion problem caused by corona interaction. Corona interaction is caused mainly by corona effluents (oxides of nitrogen etc.) oxidizing the charge transport molecules in the transport layer especially in the surface region, rendering the surface region conductive. A conductive surface region is unable to maintain a latent charge pattern resulting in loss of resolution and deletions in the image.

Thus, the characteristics of many electrostatographic imaging members comprising a supporting substrate coated on one side with at least one photoconductive layer exhibit deficiencies which are undesirable in automatic, cyclic electrostatographic copiers, duplicators, and printers.

SUMMARY OF THE INVENTION

It is an object of the invention to provide an electrostatographic imaging member which overcomes the above-noted disadvantages.

It is an object of this invention to provide an electrostatographic imaging member process with improved resistance to curling.

It is an object of this invention to provide an electrostatographic imaging member which is less complex.

It is an object of this invention to provide an electrostatographic imaging member capable of being fabricated with a simpler coating process.

It is another object of this invention to provide an electrostatographic imaging member free of an anticurl backing layer.

It is still another object of this invention to provide an electrostatographic imaging member free of an anticurl backing layer and yet can be operated at high speed.

It is yet another object of this invention to provide an electrostatographic imaging member having improved resistance to the formation of ripples in the form of crossweb sinusoidal deformations when subjected to extended image cycling.

It is another object of this invention to provide an electrostatographic imaging member exhibiting an increased cycling life.

It is still another object of this invention to provide an electrostatographic imaging member having improved resistance to corona induced deletion.

The foregoing objects and others are accomplished in accordance with this invention by providing a flexible electrophotographic imaging member comprising a substrate a charge generating layer and a charge transport layer, the transport layer comprising a first charge transport material represented by the following formula:

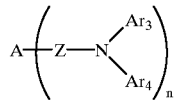

wherein n is 0 or 1, when n=0, A is

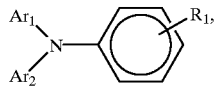

when n=1, A is selected from the group consisting of

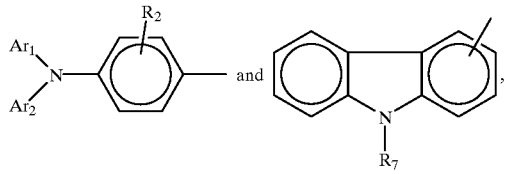

$Ar_1$ and $Ar_2$ are independently selected from the group consisting of

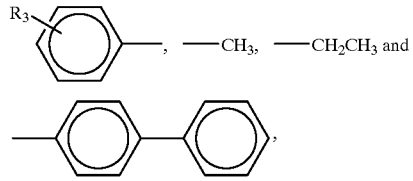

$Ar_3$ and $Ar_4$ are independently selected from the group consisting of

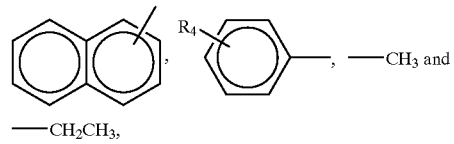

Z is selected from the group consisting of

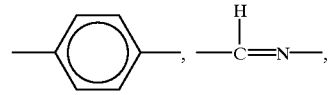

-continued

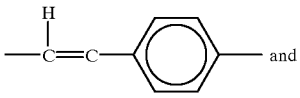

and

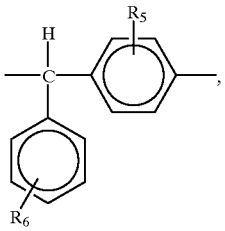

$R_{1-7}$ are independently selected from the group consisting of

—H, —$CH_3$, —$C_2H_5$, —$C(CH_3)_3$, —Cl and —$OCH_3$, and a different second charge transporting material represented by the formula

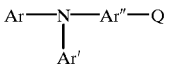

wherein:

Q is represented by the formula:

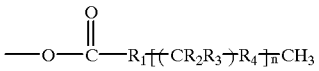

wherein:

$R_1$ and $R_4$ are independently selected from the group consisting of:

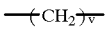

and $R_2$ and $R_3$ are independently selected from the group consisting of:

—H, —$(CH_2)_vCH_3$, —$CH(CH_3)_2$ and —$C(CH_3)_3$ wherein v is 1 to 10, n is 0 to 10, Ar" is

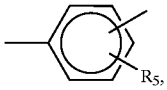

Ar is

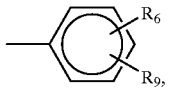

Ar' is selected from the group consisting of

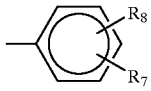

and

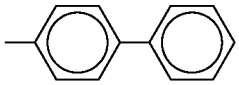

, and wherein $R_5$, $R_6$, $R_7$, $R_8$ and $R_9$ are independently selected from the group consisting of —H, —$CH_3$, —$CH_2CH_3$, —$CH_2$—$CH_2$—$CH_3$ and —$C(CH_3)_3$ dissolved or molecularly dispersed in a film forming binder, the charge transport layer having been formed by drying a coating comprising a solution of the first charge transporting material and second charge transporting material and the film forming polymer binder in a mixture of a low volatility solvent and a high volatility solvent at a temperature sufficient to retain residual low volatility solvent in the transport layer after said drying, the charge transport layer comprising between about 37 percent and about 57 percent by weight of the first charge transporting material, between about 3 percent and about 10 percent of weight of the second charge transporting material, and between about 60 percent and about 40 percent by weight of the film forming binder.

The term "substrate", as employed herein, is defined as flexible member comprising a solid thermoplastic polymer that is uncoated or coated on the side to which a charge generating layer and a charge transport layer are to be applied and free of any anticurl backing layer on the opposite side.

Generally, the imaging member comprises a flexible supporting substrate having an electrically conductive surface and at least one imaging layer. The imaging layer may be a single layer combining the charge generating and charge transporting functions or these functions may be separated, each in its own optimized layer. The flexible supporting substrate layer having an electrically conductive surface may comprise any suitable flexible web or sheet comprising, for example, a solid thermoplastic polymer. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient mechanical strength to support the electrophotoconductive layer or layers. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, copper, iodide, carbon black, graphite and the like dispersed in the solid thermoplastic polymer. The flexible conductive layer may vary in thickness over substantially wide ranges depending on the desired use of the electrophotoconductive member. Accordingly, the conductive layer can generally range in thicknesses of from about 50 Angstrom units to about 150 micrometers. When a highly flexible photoresponsive imaging device is desired, the thickness of the conductive layer may be between about 100 Angstrom units to about 750 Angstrom units. Any suitable underlying flexible support layer of any suitable material containing a thermoplastic film forming polymer alone or a thermoplastic film forming polymers in combination with other materials may be used. Typical underlying flexible support layers comprising film forming polymers include, for example, polyethylene terepthalate, polyimide, polysulfone, polyethylene naphthalate, polypropylene, nylon, polyester, polycarbonate, polyvinyl fluoride, polystyrene and the like. Specific examples of supporting substrates included polyethersulfone (Stabar S-100, available from ICI), polyvinyl fluoride (Tedlar, available from E.I. DuPont de Nemours & Company), polybisphenol-A polycarbonate (Makrofol, available from Mobay Chemical Company) and amorphous polyethylene terephthalate (Melinar, available from ICI Americas, Inc.).

The coated or uncoated flexible supporting substrate layer is highly flexible and may have any number of different configurations such as, for example, a sheet, a scroll, an endless flexible belt, and the like. Preferably, the insulating web is in the form of an endless flexible belt and comprises a commercially available biaxially oriented polyethylene terephthalate substrate known as Melinex 442, available from ICI.

If desired, any suitable charge blocking layer may be interposed between the conductive layer and the photogenerating layer. Some materials can form a layer which functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because it extends cyclic stability. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino) propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]3-proprionate, (N,N'-dimethyl 3-amino)propyl triethoxylilane, N,N-dimethylaminophenyltriethoxy silane, trimethoxysilylpropyidiethylenetriamine, and the like and mixtures thereof.

Generally, satisfactory results may be achieved when the reaction product of a hydrolyzed silane and metal oxide layer forms a blocking layer having a thickness between about 20 Angstroms and about 2,000 Angstroms.

In some cases, intermediate layers between the blocking layer and the adjacent charge generating or photogenerating layer may be desired to improve adhesion or to act as an electrical barrier layer. If such layers are utilized, they preferably have a dry thickness between about 0.01 micrometer and about 5 micrometers. Typical adhesive layers include film forming polymers such as polyester, polyvinylbutyral, polyvinylpyrolidone, polyurethane, polymethyl methacrylate and the like.

Electrophotographic imaging members comprise at least one imaging layer. Single imaging layers comprise photoconductive material, charge transport material and a film forming binder. Multiple imaging layers usually comprise a charge generating layer comprising a charge generating material and a charge transport layer comprising a charge transport material.

Typically, a preferred electrophotoconductive imaging member of this invention comprises a supporting substrate layer, a metallic conductive layer, a charge blocking layer, an optional adhesive layer, a charge generator layer, a charge transport layer. The electrophotoconductive imaging member of this invention is preferably free of any anticurl layer on the side of the substrate layer opposite the electrically active charge generator and charge transport layers, although a back coating may be optionally present to provide some other benefit such as increased traction and the like. Back coating for traction is distinguished from the anticurl back coating in that the optional layer for traction does not have to meet the stringent thickness requirements of the anticurl back coating. The stringent thickness tolerances of the anticurl back coating results from the need to exactly counter balance the stress of the electrically active coating. This stress balance is required to maintain the flatness. Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. Nos. 4,489,143, 4,4507,480, U.S. Pat. Nos. 4,306,008, 4,299,897, U.S. Pat. No. 4,232,102, U.S. Pat. No. 4,233,383, U.S. Pat. No. 4,415,639 and U.S. Pat. No. 4,439,507. The disclosure of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is important that there be particle-to-particle contact between the photoconductive particles. This necessitates that the photoconductive material be present in an amount of at least about 15 percent by volume of the binder layer with no limit on the maximum amount of photoconductive material present in the binder layer. If the matrix or binder comprises an active material, e.g. poly (N-vinyl carbazole), a photoconductive material need only comprise about 1 percent or less by volume of the binder layer with no limitation on the maximum amount of photoconductor in the binder layer. Generally for generator layers containing an electrically active matrix or binder such as poly(N-vinyl carbazole) or poly(hydroxyether), preferably from about 5 percent by volume to about 60 percent by volume of the photogenerating pigment is dispersed in about 95 percent by volume to about 40 percent by volume of binder, and preferably from about 7 percent to about 30 percent by volume of the photogenerating pigment is dispersed in from about 93 percent by volume to about 70 percent by volume of the binder. The specific proportions selected also depends to some extent on the thickness of the generator layer.

The thickness of the photogenerating binder layer is not particularly critical. Layer thicknesses from about 0.05 micrometer to about 40 micrometers have been found to be satisfactory. The photogenerating binder layer containing photoconductive compositions and/or pigments, and the resinous binder material preferably ranges in thickness of from about 0.1 micrometer to about 5 micrometers, and has an optimum thickness of from about 0.3 micrometer for best light absorption and improved dark decay stability and mechanical properties.

Other typical photoconductive layers include amorphous or alloys of selenium such as selenium-arsenic, selenium-tellurium-arsenic, selenium-tellurium, and the like.

The relatively thick active charge transport layer, in general, comprises a mixture of transport molecules including a first amount of a first charge transport material, free of long chain alkyl ester groups and alkyl carboxylate side groups, the first charge transport material being represented by the following formula:

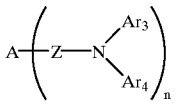

wherein n is 0 or 1, when n=0, A is selected from

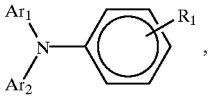

when n=1, A is selected from the group consisting of

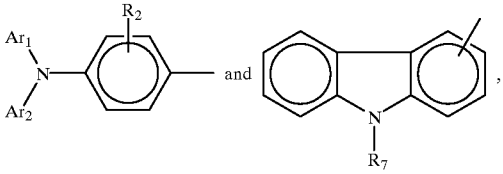

$Ar_1$ and $Ar_2$ are independently selected from the group consisting of

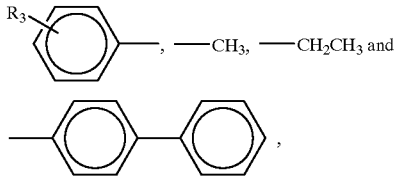

$Ar_3$ and $Ar_4$ are independently selected from the group consisting of

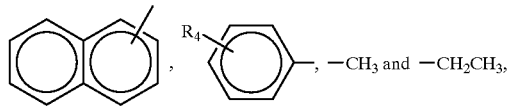

Z is selected from the group consisting of

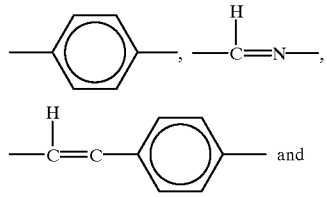

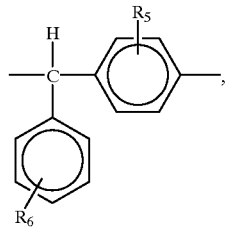

$R_{1-7}$ are independently selected from the group consisting of:

—H, —$CH_3$, —$C_2H_5$, —$C(CH_3)_3$, —Cl and —$OCH_3$, and a second amount of a different second hole transport molecule having only one long chain alkyl ester groups dissolved or molecularly dispersed in a film forming binder, the first amount of the first hole transporting material being greater than the second amount of the second hole transporting material.

The charge transport layer is coated from a mixture of solvents comprising a first amount of a first solvent having high volatility and a second amount of a second solvent having low volatility, the first amount of the first solvent having high volatility being greater than the second amount of the second solvent having low volatility solvent. The charge transport layer should also be capable of supporting the injection of photo-generated holes or electrons from the charge transport layer and allowing the transport of these holes or electrons through the charge transport layer to selectively discharge the surface charge. The term "dissolved" as employed herein is defined as forming a solution in which the transporting materials are dissolved in the film forming binder to form a homogeneous phase. The expression "molecularly dispersed" as used herein is defined as the charge transporting materials dispersed in the film forming binder, the charge transporting materials being dispersed in the polymer on a molecular scale. The expression "charge transporting materials" is defined herein as a material that allows the free charge photogenerated in the generator layer and injected into the transport layer to be transported across the transport layer. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the charge generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

The active charge transport layer must contain a mixture of a first hole transporting molecule free of long chain alkyl ester group with a small concentration of a second hole transporting material containing only one long chain alkyl ester group dissolved or molecularly dispersed in a film forming binder. The film forming binder alone is incapable of supporting the injection of photogenerated holes from the generation material and incapable of allowing transport of holes there through. However, the addition of hole transporting materials to the film forming binder polymeric materials forms a composition that is electrically active, that is, capable of supporting the injection of photogenerated holes from the generation material and capable of allowing the transport of these holes through the active layer to discharge the surface on the active layer.

The mixture of a first hole transporting molecule free of long chain alkyl ester group with a small concentration of a second hole transporting material containing only one long chain alkyl ester group can also be added to film forming charge transporting polymeric materials. Addition of these hole transporting materials containing mixture of first hole transporting molecule free of long chain alkyl ester group and a small concentration of a second hole transporting material containing only one long chain alkyl ester group will convert the electrically active polymeric material to a material capable of transport of the charge with increased charge carrier mobilities, as well as supporting the injection of photogenerated holes from the generation material, and making the resulting layer stress free.

The hole transporting materials containing only one long chain alkyl ester groups is derived from a charge transporting reactant selected from the group consisting of phenolic containing tertiary amine molecules and the like and mixtures thereof. Typical phenolic reactants include, for example:

N,N-diphenyl-N-[3-hydroxyphenyl]amine,
N-phenyl-N-[4-methylphenyl]-N-[3-hydroxyphenyl]amine,
N-phenyl-N-[3,4-dimethylphenyl]-N-[3-hydroxyphenyl]amine,
N,N-bis[3,4-dimethylphenyl]-N-[3-hydroxyphenyl]amine,
N,N-bis[4-methylphenyl]-N-[3-hydroxyphenyl]amine,
N-phenyl-N-[1-biphenyl]-N-[3-hydroxyphenyl]amine,
N-[4-methylphenyl]-N-[1-biphenyl]-N-[3-hydroxyphenyl]amine,
N-[3,4-dimethylphenyl]-N-[1-biphenyl]-N-[3-hydroxyphenyl]amine,
N,N-diphenyl-N-[4-hydroxyphenyl]amine,
N-phenyl-N-[4-methylphenyl]-N-[4-hydroxyphenyl]amine,
N-phenyl-N-[3,4-dimethylphenyl]-N-[4-hydroxyphenyl]amine,
N,N-bis[3,4-dimethylphenyl]-N-[4-hydroxyphenyl]amine,
N,N-bis[4-methylphenyl]-N-[4-hydroxyphenyl]amine,
N-phenyl-N-[1-biphenyl]-N-[4-hydroxyphenyl]amine,
N-[4-methylphenyl]-N-[1-biphenyl]-N-[4-hydroxyphenyl]amine,
N-[3,4-dimethylphenyl]-N-[1-biphenyl]-N-[4-hydroxyphenyl]amine.

These phenolic containing tertiary amine molecules can be represented by the following formula:

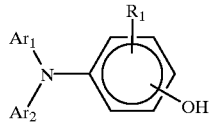

wherein $Ar_1$ is

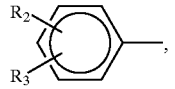

$Ar_2$ is selected from the group consisting of:

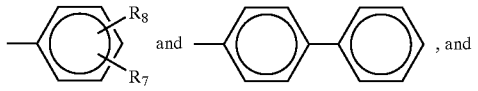

$R_1$, $R_2$ and $R_3$ are independently selected from the group consisting of

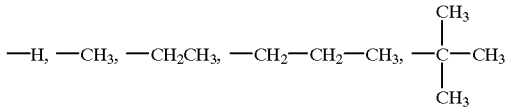

Preferred charge transporting long chain alkyl ester group containing materials of this invention can be represented by the following formula:

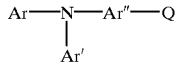

wherein:

Q is represented by the formula:

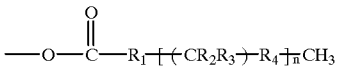

wherein:

$R_1$ and $R_4$ are independently:

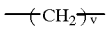

$R_2$ and $R_3$ are independently selected from the group consisting of:

—H, $—(CH_2)_v—CH_3$, $—CH(CH_3)_2$ and $—C(CH_3)_3$, wherein v is 1 to 10, n is 0 to 10, Ar" is

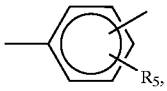

Ar is

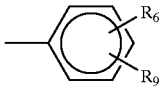

and

Ar' is selected from the group consisting of:

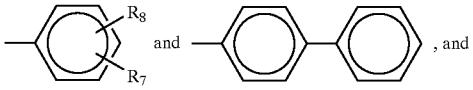

wherein $R_5$, $R_6$, $R_7$, $R_8$ and $R_9$ are independently selected from the group consisting of —H, $—CH_3$, $—CH_2CH_3$, $—CH_2—CH_2—CH_3$ and $—C(CH_3)_2—CH_3$.

A preferred charge transporting unit that ultimately attaches to long chain alkyl ester groups is an arylamine. Typical arylamines which attach to long chain alkyl ester groups include, for example,

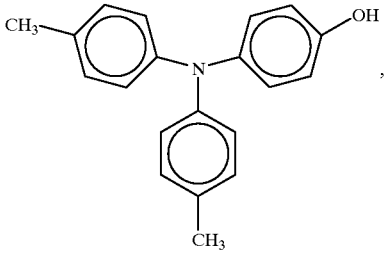

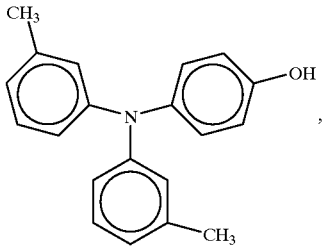

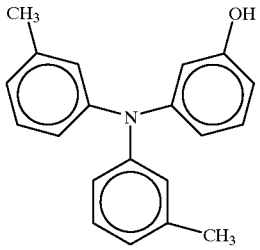

and the like.

The charge transporting phenolic containing tertiary amine molecules described above are reacted with a coreactant to form the hole transporting materials containing only one long chain alkyl ester group. A preferred coreactant is an acid chloride. Typical acid chlorides include, for example, octanoyl chloride, decanoyl chloride, dodecanoyl chloride, tetradecanoyl chloride and the like.

Preferably, the arylamine attached to a long chain alkyl ester group is a triphenylamine, e.g., N,N-bis[4-methylphenyl]-N-[3-phenyldecanoate]amine represented by the following formula:

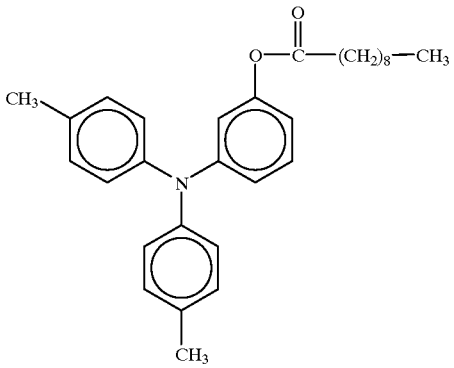

Other long chain triarylamine products containing a long chain alkyl ester group include, for example, N,N-diphenyl-N-[3-phenyldecanoate]amine, N-phenyl-N-[4-methylphenyl]-N-[3-phenyldecanoate] amine, N-phenyl-N-[3,4-dimethylphenyl]-N-[3-phenyldecanoate] amine, N,N-bis[3,4-dimethylphenyl]-N-[3-decanoatephenyl] amine, N,N-bis[4-methylphenyl]-N-[3-phenyldecanoate]amine, N-phenyl-N-[1-biphenyl]-N-[3-phenyldecanoate]amine, N-[4-methylphenyl]-N-[1-biphenyl]-N-[3-phenyldecanoate]amine, N-[3,4-dimethylphenyl]-N-[1-biphenyl]-N-[3-phenyldecanoate]amine, and specific arylamine phenolic reactants include, for example, N,N-diphenyl-N-[4-hydroxyphenyl]amine, N-phenyl-N-[4-methylphenyl]-N-[4-hydroxyphenyl]amine, N-phenyl-N-[3,4-dimethylphenyl]-N-[4-hydroxyphenyl] amine, N,N-bis[3,4-dimethylphenyl]-N-[4-hydroxyphenyl]amine, N,N-bis[4-methylphenyl]-N-[4-hydroxyphenyl]amine, N-phenyl-N-[1-biphenyl]-N-[4-hydroxyphenyl]amine, N-[4-methylphenyl]-N-[1-biphenyl]-N-[4-hydroxyphenyl] amine, N-[3,4-dimethylphenyl]-N-[1-biphenyl]-N-[4-hydroxyphenyl]amine and the like. Similar products include the octanoates, dodecanoates and tetradecanoates of the above arylamines and the like.

Examples of the first charge transporting aromatic amines, free of long chain alkyl ester groups and long chain alkyl carboxylate groups, for admixing with transporting material containing only one long chain alkyl ester group include conventional charge transporting aromatic amines such as those represented by the formula:

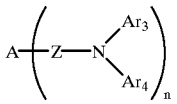

wherein n is 0 or 1, when n is 0, A is selected from

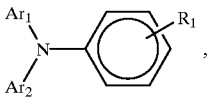

when n is 1, A is selected from the group consisting of

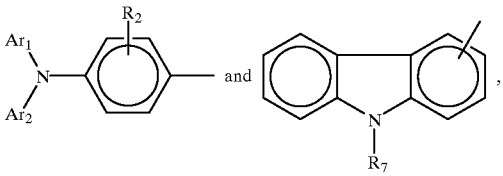

$Ar_1$ and $Ar_2$ are independently selected from the group consisting of

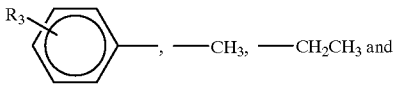

-continued

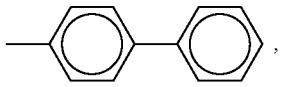

$Ar_3$ and $Ar_4$ are independently selected from the group consisting of

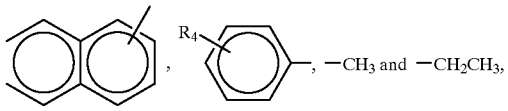

Z is selected from the group consisting of

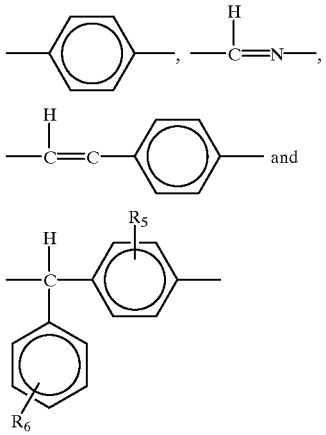

$R_{1-7}$ are independently selected from the group consisting of

—H, —$CH_3$, —$C_2H_5$, —$C(CH_3)_3$, —Cl, and —$OCH_3$.

Typical conventional charge transporting aromatic amines, free of long chain alkyl ester groups and long chain alkyl carboxylate groups include, for example, bis(4-diethylamine-2-methylphenyl)phenylmethane; 4'-4"-bis(diethylamino)-2,2"-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, and the like. A preferred conventional charge transporting aromatic amine is N,N'-diphenyl-N,N'-bis(3-methyl-phenyl)-(1,1' biphenyl)-4,4'-diamine. The charge transport layer of the photoreceptor of this invention may contain between about 3 and about 50 per cent by weight of the conventional hole transporting material free of long chain alkyl ester groups and long chain alkyl carboxyl groups, based on the total weight of the dried transport layer. In all of the above charge transport layers, the total activating compounds which renders electrically inactive polymeric material electrically active is preferably present in amounts of from about 30 to about 60 per cent by weight, based on the total weight of the dried transport layer.

Any suitable inactive resin binder soluble in the charge transport layer coating composition solvents may be employed in the process of this invention. Typical inactive resin binders soluble in solvents include, for example, polycarbonate resin, polystyrene resins, polyether carbonate resins, polyester resins, copolyester resins, terpolyester resins, polystyrene resins, polyarylate resins and the like and mixtures thereof. Preferred polycarbonate resins include, for example, poly(4,4'-isopropylidenediphenyl carbonate) [polycarbonate A]; polyether carbonate resins; 4,4'-cyclohexylidene diphenyl polycarbonate [polycarbonate Z]; poly(4,4'-isopropylidene-3,3'-dimethyl-diphenyl-carbonate) [polycarbonate P]; and the like. Weight average molecular weights can vary from about 20,000 to about 1,500,000.

The preferred electrically inactive resin materials are polycarbonate resins have a weight average molecular weight from about 20,000 to about 100,000, more preferably from about 50,000 to about 100,000. The materials most preferred as the electrically inactive resin material is poly (4,4'-isopropylidene-diphenylene carbonate) with a molecular weight of from about 35,000 to about 40,000 (available as Lexan 145 from General Electric Company); poly (4,4'-isopropylidene-diphenylene carbonate) with a molecular weight of from about 40,000 to about 45,000 (available as Lexan 141 from General Electric Company); a polycarbonate resin having a molecular weight of from about 50,000 to about 100,000, (available as Makrolon from Farbenfabricken Bayer A.G.) and a polycarbonate resin having a molecular weight of from about 20,000 to about 50,000 (available as Merlon from Mobay Chemical Company). The most preferred polycarbonates resins are polycarbonate A, polycarbonate C and polycarbonate Z. Preferably, the charge transport layer comprises between about 60 percent and about 40 percent by weight of the polycarbonate film forming binder, based on the total weight of the transport layer, between about 37 percent and about 57 percent by weight of the first charge transport molecule material, free of long chain alkyl ester groups and alkyl carboxylate groups, and between about 3 percent and about 10 percent of weight of the different second hole transport molecule containing only one long chain alkyl ester group, based on the total weight of the transport layer.

A mixture of high volatility and low volatility solvents is employed to coat the transport layer. Methylene chloride solvent, being an excellent solvent for all of the components, is a desirable component of the charge transport layer coating mixture for adequate dissolving of all the components and for its high volatility. Volatility refers to the evaporation rates. A numerical value of one is assigned to the volatility of diethyl ether. A solvent with a slower evaporation rate than diethyl ether would require a longer time to evaporate and therefore would have a higher volatility number (requires a longer time to evaporate at the same initial temperature and atmospheric pressure) High volatility solvents have a volatility of between about 1 and about 3. Thus, a high volatility solvent has a volatility rate ranging from the volatility rate of diethyl ether (volatility of 1) to a volatility of 3. The low volatility solvent in the solvent mixture to coat the transport layer is selected from the group consisting of monochlorobenzene, dichlorobenzene or trichlorobenzene or mixtures thereof, the mixtures being of any two or all three. Low volatility solvents have a volatility of between about 5 and about 300 or more. The volatility number for methylene chloride is 1.8, for monochlorobenzene is 8.2, dichlorobenzene is 40 and trichlorobenzene is greater than 100. The concentration of the low volatility solvent depends on the concentration of the charge transport molecule containing only one long chain alkyl ester group and the effect of both is to form a transport layer that is substantially free of internal stress. The expression "substantially free of internal stress" as employed herein is defined as lacking in unbalanced internal forces in the bulk which can lead to physical distortion of materials. When more than about 10 weight percent, based on the total weight of the dried transport layer, of the transport molecule containing only one long chain alkyl ester group is employed, the charge carrier mobilities of the transport layer drops below the value required for acceptable operation in high speed or high quality reproduction machines. The drop in mobilities is caused by the effect of an overabundance of the long alkyl ester group chains which are essentially non-charge transporting. More specifically, for a given weight concentration of transport molecules containing only one long chain alkyl ester group, the presence of the long chain alkyl ester groups reduces the number of transporting units. Also, the dipole content of the long chain alkyl ester groups reduces the charge carrier mobilities. In the absence of the charge transport molecule containing long chain alkyl ester group, the concentration of the low volatility solvent required to obtain stress free devices can be as high as 10 weight percent of the total solvent required to coat the transport layer. By adding a small concentration of the molecule containing a long chain alkyl ester group, the concentration of the low volatility solvent required to produce curl free photoreceptors is very low. There seems to be a synergistic effect. The presence of the small concentration of the charge transport molecule containing a long chain alkyl ester group does not adversely impact the charge carrier mobility. As an example, for a transport layer containing 45 weight percent of the conventional transport molecule and 5 weight percent of the charge transport molecule containing a long chain alkyl ester group, based on the total weight of the dried transport layer, the amount of the low volatility solvent required to produce stress free, curl free devices is less than 3 weight percent of the total solvent employed to form the coating solution. Preferably, the transport layer is coated from a mixture of between about 95 and about 98 percent by weight of the high volatility solvent and between about 5 and about 2 weight per cent of the low volatility solvent, based on the total weight of the solvent employed to make the coating solution. Preferably, the retained residual low volatility solvent in the transport layer after drying is between about 1 percent and about 12 percent by weight, based on the total weight of the transport layer after drying.

The surprising discovery is that the 5 weight percent of the molecule N, N-bis[4-methylphenyl]-N-[3-phenyldecanoate]amine when added to 45 weight percent of N,N'-diphenyl-N,N'-bis(3"-methylphenyl)-(1,1'-biphenyl)-4,4'-diamine and the remaining 50 weight percent being polycarbonate, the stability of the transport layer surface against corona induced degradation normally leading to resolution loss and deletion is significantly improved over the prior art. A transport layer containing 5 weight percent of N,N-bis[4-methylphenyl]-N-[3-phenyldecanoate]amine and 45 weight percent of N,N'-diphenyl-N,N'-bis(3"-methylphenyl)-(1,1'-biphenyl)-4,4'-diamine, based on the total weight of the dried transport layer, in polycarbonate coated from a solvent mixture of 97 weight percent methylene chloride and 3 weight percent 1,2,4 trichlorobenzene, based on the total weight of the solvents, is not only stress free and curl free but is also significantly more-resistant to corona induced deletion than the curl free transport layer compositions of the prior art.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used where suitable.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained between about 2:1 to 200:1 and in some instances as great as 400:1.

Anticurl backing layers are conventionally applied to the backside of the substrate layer, i.e. the side of the substrate opposite the side carrying the charge generating layer and charge transport layer. Since the layers of the final dried electrophotographic imaging member of this invention is substantially free of stress, no anticurl backing layer is needed to prevent curl. Thus, the dried electrophotographic imaging member of this invention is preferably free of an anticurl backing layer. However, other coatings may be utilized on the back side of the substrate if desired, e.g. lubricating coatings, protective coatings, coatings for increased traction, and the like even if the dried electrophotographic imaging member of this invention is free of an anticurl backing layer. Generally, an anticurl backing layer is relatively thick, e.g. between about 10 micrometers and about 30 micrometers, depending on the thickness of the transport layer, whereas other optional coatings are much thinner such as between about 0 micrometers and about 5 micrometers.

Optionally, a thin overcoat layer may be utilized to improve resistance to abrasion. These overcoating layers may comprise organic polymers or inorganic polymers that are electrically insulating or slightly semi-conductive.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

N,N-bis[4-methylphenyl]-N-[3-phenyldecanoate]amine was prepared, for example, by placing in a two liter three-necked round bottom flask, equipped with a mechanical stirrer and an argon inlet 22,4 grams potassium hydroxide [0.4 moles], 2.3 grams benzyltriethylammonium chloride [0.01 moles], 400 grams deionized water, 57.8 grams N,N-bis[4-methylphenyl]-N-[3-hydroxyphenyl]amine [0.2 moles] and 100 milliliters 1,3-dioxolane. The clear solution was stirred and cooled to 5° C. in an ice water bath. Over a period of 30 minutes with vigorous stirring, a solution of 40 grams decanoyl chloride [0.21 moles] was slowly added to 400 milliliters methylene chloride. After the addition was complete, the ice bath was removed and the mixture was stirred for one hour. The contents of the flask was transferred to a two liter separatory funnel and the organic phase was separated from the alkaline water phase. The organic phase was washed twice with 300 milliliters of water and then dried with anhydrous magnesium sulfate. The water-free organic layer was subjected to a roto-evaporator and the oily residue was dissolved in 500 milliliters hexane. The hexane solution was stirred for two hours with 25 grams Florisil, followed by filtration. The colorless solution was subjected to roto-evaporation and the oily residue was dissolved in 400 milliliters hot 2-propanol. The solution was allowed to crystallize at 0° C. The precipitate was filtered and dried to yield 57 grams [65 percent] of colorless crystals. M.P. 48–50° C.

EXAMPLE II

Six flexible photoreceptor sheets were prepared by forming coatings using conventional techniques on a substrate comprising a vacuum deposited titanium layer on a flexible polyethylene terephthalate film having a thickness of 3 mil (76.2 micrometers). The first applied coating was a siloxane barrier layer formed from hydrolyzed gamma aminopropyltriethoxysilane having a thickness of 0.005 micrometer (50 Angstroms). This layer was coated from a mixture of 3-aminopropyltriethoxysilane (available from PCR Research Chemicals of Florida) in ethanol in a 1:50 volume ratio. The coating was applied to a wet thickness of 0.5 mil by a multiple clearance film applicator. The coating was then allowed to dry for 5 minutes at room temperature, followed by curing for 10 minutes at 110 degree centigrade in a forced air oven. The next applied coating was an adhesive layer of polyester resin (49,000, available from E.I. duPont de Nemours & Co.) having a thickness of 0.005 micron (50 Angstroms) and was coated from a mixture of 0.5 gram of 49,000 polyester resin dissolved in 70 grams of tetrahydrofuran and 29.5 grams of cyclohexanone. The coating was applied by a 0.5 mil bar and cured in a forced air oven for 10 minutes. This adhesive interface layer was thereafter coated with a photogenerating layer (CGL) containing 40 percent by volume hydroxygallium phthalocyanine and 60 percent by volume copolymer polystyrene (82 percent)/poly-4-vinyl pyridine (18 percent) with a $M_w$ of 11,000. This photogenerating coating mixture was prepared by introducing 1.5 grams polystyrene/poly-4-vinyl pyridine and 42 ml of toluene into a 4 oz. amber bottle. To this solution was added 1.33 grams of hydroxygallium phthalocyanine and 300 grams of ⅛ inch diameter stainless steel shot. This mixture was then placed on a ball mill for 20 hours. The resulting slurry was thereafter applied to the adhesive interface with a Bird applicator to form a layer having a wet thickness of 0.25 mil. The layer was dried at 135° C. for 5 minutes in a forced air oven to form a dry photogenerating layer having a thickness of 0.4 micrometer.

Six coated members prepared as described above were created with charge transport layers containing N,N'-diphenyl-N,N'-bis(3-methyl-phenyl)-(1,1'biphenyl)-4,4'-diamine (DBBD), N,N-bis[4-methylphenyl]-N-[3-phenyldecanoate]amine (TTA-decyl) and N,N'-diphenyl-N,N'-bis{3-{oxypentyl ethylcarboxylate}phenyl}-4,4'-biphenyl-1,1'diamine (DBBD-OPEC) molecularly dispersed in a polycarbonate resin [poly(4,4'-isopropylidene-diphenylene carbonate, available as Makrolon® from Farbenfabricken Bayer A.G.]. The first four transport layers were coated using methylene chloride only. The fifth and sixth devices were coated from a mixture of methylene chloride and trichlorobenzene. First 1.2 grams of polycarbonate polymer was dissolved in 13.2 grams of the solvent to form a polymer solution. X grams of DBBD and Y grams of either TTA-decyl or DBBD-OPEC were dissolved in the polymer solution. The charge transport layer coatings were formed using a Bird coating applicator. The N,N'-diphenyl-N,N'bis(3-methyl-phenyl)-(1,1'biphenyl)-4,4'-diamine (DBBD), N,N-bis[4-methylphenyl]-N-[3-phenyldecanoate]amine (TTA-decyl) and N,N'-diphenyl-N,N'-bis{3-{oxypentyl ethylcarboxylate}phenyl}-4,4'-biphenyl-1, 1'diamine (DBBD-OPEC) are electrically active aromatic diamine or amine charge transport small molecule whereas the polycarbonate resin is an electrically inactive film forming binder. Each of the coated devices were dried at 80° C. for half an hour in a forced air oven to form a 25 micrometer thick charge transport layer on the coated members. The compositions of six transport layers on the coated members are shown in the table below. Device No 6 is a device of the prior art.

| Device # | Polycarbonate | DBBD | TTA-decyl | DBBD-OPEC | $CH_2Cl_2$ | TCB |
|---|---|---|---|---|---|---|
| 1 | 1.2 gm | 1.2 gm | | | 100% | |
| 2 | 1.2 gm | 1.08 gm | 0.12 gm | | 100% | |
| 3 | 1.2 gm | 0.96 gm | 0.24 gm | | 100% | |
| 4 | 1.2 gm | 0.72 gm | 0.48 gm | | 100% | |
| 5 | 1.2 gm | 1.08 gm | 0.12 gm | | 95% | 5% |
| 6 | 1.2 gm | 1.08 gm | | 0.12 gm | 95% | 5% |

EXAMPLE III

The six flexible photoreceptor sheets prepared as described in Example II were tested for flatness by placing them in an unrestrained condition on a flat surface. Photoreceptor device No. 1 curled upwardly into a small diameter roll. Photoreceptor devices No 2 and 3 curled upwardly but with less curl than device No 1. Devices Nos. 4, 5 and 6 laid flat. No curl was observed in these three flexible photoreceptor sheets.

EXAMPLE IV

The flexible photoreceptor sheets prepared as described in Example II were tested for their xerographic sensitivity and cyclic stability. Each photoreceptor sheet to be evaluated was mounted on a cylindrical aluminum drum substrate which was rotated on a shaft. The device was charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed by a light source located at a position near the drum downstream from the corotron. As the drum was rotated, the initial (pre-exposure) charging potential was measured by voltage probe 1. Further rotation led to the exposure station, where the photoreceptor device was exposed to monochromatic radiation of known intensity. The device was erased by a light source located at a position upstream of charging. The measurements made included charging of the photoconductor device in a constant current or voltage mode. The device was charged to a negative polarity corona. As the drum was rotated, the initial charging potential was measured by voltage probe 1. Further rotation lead to the exposure station, where the photoreceptor device was exposed to monochromatic radiation of known intensity. The surface potential after exposure was measured by voltage probes 2 and 3. The device was finally exposed to an erase lamp of appropriate intensity and any residual potential was measured by voltage probe 4. The process was repeated with the magnitude of the exposure automatically changed during the next cycle. The photodischarge characteristics was obtained by plotting the potentials at voltage probes 2 and 3 as a function of light exposure. The charge acceptance and dark decay were also measured in the scanner. The PhotoInduced Discharge characteristics (PIDC) and the cyclic stability of all the six devices were essentially equivalent.

EXAMPLE V

A deletion resistance test was conducted in which a negative corotron was operated (with high voltage connected to the corotron wire) opposite a grounded electrode for several hours. The high voltage was then turned off, and the corotron was placed (or parked) for thirty minutes on a segment of the photoconductor device being tested. Only a short middle segment of the photoconductor device was thus exposed to the corotron effluents. Unexposed regions on either side of the exposed regions were used as controls. The photoconductor device was then tested in a scanner for positive charging properties for systems employing donor type molecules. These systems were operated with negative polarity corotron in the latent image formation step. An electrically conductive surface region (excess hole concentration) appeared as a loss of positive charge acceptance or increased dark decay in the exposed regions (compared to the unexposed control areas on either side of the short middle segment). Since the electrically conductive region was located on the surface of the photoreceptor device, a negative charge acceptance scan was not affected by the corotron effluent exposure (negative charges do not move through a charge transport layer made up of donor molecules). However, the excess carriers on the surface cause surface conductivity resulting in loss of image resolution, in severe cases, causes deletion. The photoreceptor devices, No 5 of the present invention and 6 of the prior art, were tested for deletion resistance. The region not exposed to corona effluents charged to 1000 volts positive in both cases; however the corona exposed region of device 5 charged to 870 volts (a loss of 130 volts of charge acceptance) whereas the corona exposed region of device 6 was charged to 500 volts (a loss of 500 volts of charge acceptance). The composition of this invention has improved deletion resistance by a factor of slightly over 3. This clearly demonstrates the surprisingly superior performance of a device containing an imaging layer comprising a first charge transport material, free of long chain alkyl ester groups (DBBD), and a small amount of a different second charge transporting material containing only one long chain alkyl ester group (TTA-decyl) in a film forming binder compared to an imaging layer comprising a first charge transport material, free of long chain alkyl ester groups (DBBD), and a small amount of a different second charge transporting material containing two long chain alkyl ester groups (DBBD-OPEC) in a film forming binder, both imaging layers having been formed by drying a coating comprising a solution of the first transporting material and second charge transporting material and the film forming polymer binder in a mixture of a low volatility solvent and a high volatility solvent.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A flexible electrophotographic imaging member comprising a substrate a charge generating layer and a charge transport layer, the transport layer comprising a first charge transport material represented by the following formula:

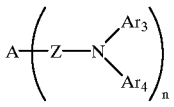

wherein n is 0 or 1, when n=0, A is

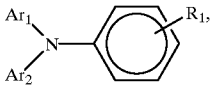

when n=1, A is selected from the group consisting of

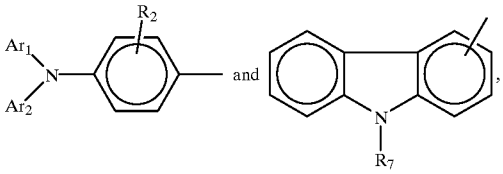

$Ar_1$ and $Ar_2$ are independently selected from the group consisting of

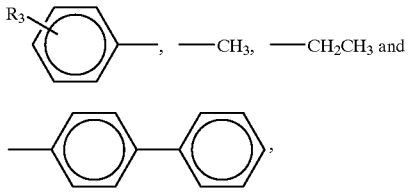

$Ar_3$ and $Ar_4$ are independently selected from the group consisting of

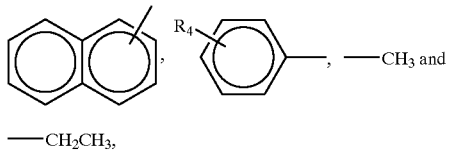

Z is selected from the group consisting of

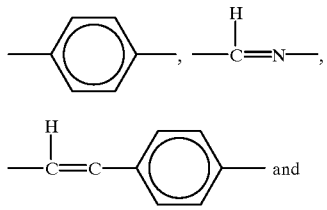

-continued

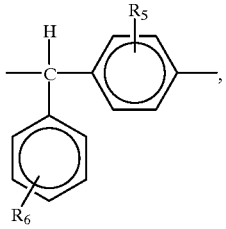

$R_{1-7}$ are independently selected from the group consisting of

—H, —$CH_3$, —$C_2H_5$, —$C(CH_3)_3$, —Cl and —$OCH_3$, and a different second charge transporting material represented by the formula

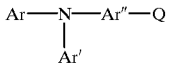

wherein:

Q is represented by the formula:

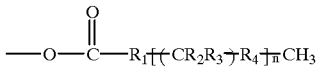

wherein:

$R_1$ and $R_4$ are independently selected from the group consisting of:

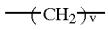

and $R_2$ and $R_3$ are independently selected from the group consisting of:

—H, —$(CH_2)_vCH_3$, —$CH(CH_3)_2$ and —$C(CH_3)_3$ wherein v is 1 to 10, n is 0 to 10, Ar" is

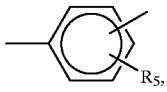

Ar is

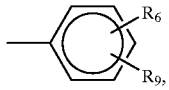

Ar' is selected from the group consisting of

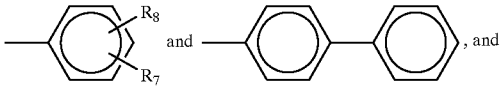

wherein $R_5$, $R_6$, $R_7$, $R_8$ and $R_9$ are independently selected from the group consisting of —H, —$CH_3$, —$CH_2CH_3$, —$CH_2$—$CH_2$—$CH_3$ and

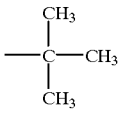

dissolved or molecularly dispersed in a film forming binder, the charge transport layer having been formed by drying a coating comprising a solution of the first charge transporting material and second charge transporting material and the film forming polymer binder in a mixture of a low volatility solvent and a high volatility solvent at a temperature sufficient to retain residual low volatility solvent in the transport layer after said drying, the charge transport layer comprising between about 37 percent and about 57 percent by weight of the first charge transporting material, between about 3 percent and about 10 percent of weight of the second charge transporting material, and between about 60 percent and about 40 percent by weight of the film forming binder.

2. A flexible electrophotographic imaging member according to claim 1 wherein the substrate has a first major side and a second major side, the at least one imaging layer being on the first major side and the second major side being free of any anticurl backing layer.

3. A flexible electrophotographic imaging member comprising a supporting substrate coated with a charge generating layer and a charge transport layer, the transport layer comprising a first amount of a first charge transport material represented by the following formula:

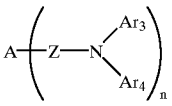

wherein n is 0 or 1, when n=0, A is

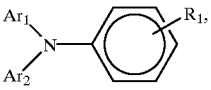

when n=1, A is selected from the group consisting of

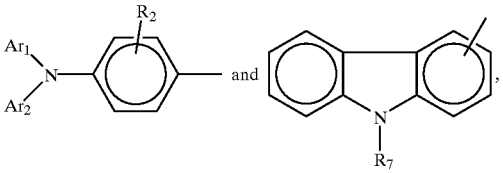

$Ar_1$ and $Ar_2$ are independently selected from the group consisting of

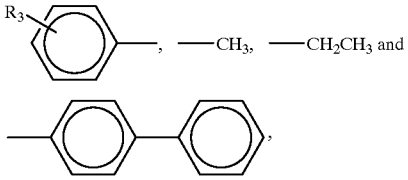

$Ar_3$ and $Ar_4$ are independently selected from the group consisting of

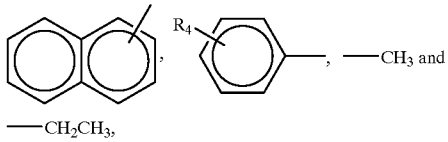

Z is selected from the group consisting of

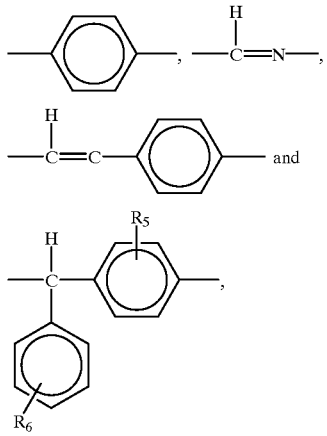

$R_{1-7}$ are independently selected from the group consisting of

—H, —$CH_3$, —$C_2H_5$, —$C(CH_3)_3$, —Cl and —$OCH_3$, and a second amount of a second transport molecule represented by the formula

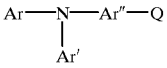

wherein:

Q is represented by the formula:

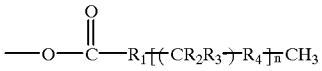

wherein:

$R_1$ and $R_4$ are independently selected from the group consisting of:

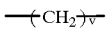

and $R_2$ and $R_3$ are independently selected from the group consisting of:

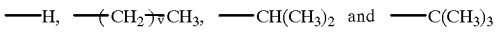

wherein v is 1 to 10, n is 0 to 10, and

Ar"

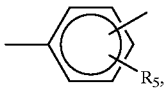

Ar is

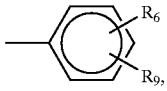

and

Ar' is selected from the group consisting of

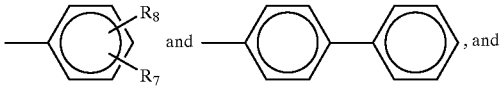

wherein $R_5$, $R_6$, $R_7$ , $R_8$ and $R_9$ are independently selected from the group consisting of

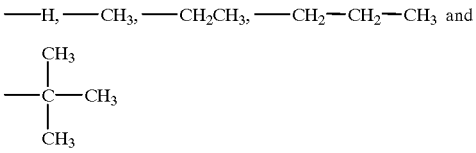

dissolved or molecularly dispersed in a film forming binder, and coated from a mixture of solvents comprising a first amount of a high volatility solvent and a second amount of low volatility solvent, the first amount of the high volatility solvent being greater than the second amount of the second low volatility solvent, and the first amount of the first hole transporting material being greater than the second amount of the second hole transporting material, a residual amount of the low volatility solvent being retained in the transport layer after drying the charge transport layer comprising between about 37 percent and about 57 percent by weight of the first charge transporting material, between about 3 percent and about 10 percent of weight of the second charge transporting material, and between about 60 percent and about 40 percent by weight of the film forming binder.

4. A flexible electrophotographic imaging member according to claim 3 wherein the transport layer is coated from a mixture of between about 95 and about 98 percent by weight of the high volatility solvent and between about 5 and about 2 weight per cent of the low volatility solvent, based on the total weight of the solvents employed in the coating solution.

5. An electrophotographic imaging member according to claim 3 wherein the second charge transporting is derived from a tertiary amine containing charge transporting reactant represented by the formula

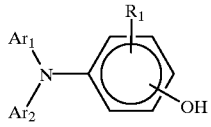

wherein $Ar_1$ is

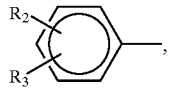

$Ar_2$ is selected from the group consisting of:

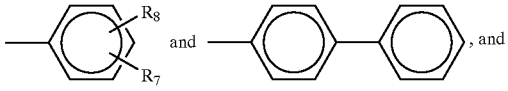

$R_1$, $R_2$, $R_3$ $R_7$ and $R_8$ are independently selected from the group consisting of

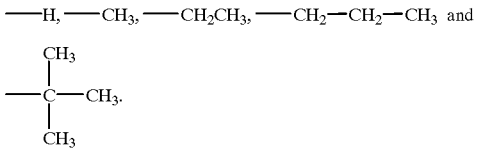

6. A flexible electrophotographic imaging member according to claim 3 wherein the second hole transporting material is N,N-bis[4-methylphenyl]-N-[3-phenyldecanoate]amine.

7. A flexible electrophotographic imaging member according to claim 3 wherein the first hole transport material is N,N'-diphenyl-N,N'-bis(3-methyl-phenyl)-(1,1' biphenyl)-4,4'-diamine.

8. An electrophotographic imaging member according to claim 3 wherein the high volatility solvent is methylene chloride.

9. An electrophotographic imaging member according to claim 3 wherein the low volatility solvent is selected from the group consisting of monochlorobenzene, dichlorobenzene, trichlorobenzene, mixtures of any two of these solvents and mixtures of all three of these solvents.

10. An electrophotographic imaging member according to claim 3 wherein the supporting substrate comprises polyethylene terepthalate.

11. An electrophotographic imaging member according to claim 3 wherein the transport layer in substantially free of internal stress.

12. An electrophotographic imaging member according to claim 3 wherein the film forming binder comprises a polycarbonate.

13. An electrophotographic imaging member according to claim 12 wherein the polycarbonate film forming binder is selected from the group consisting of polycarbonate A, polycarbonate C and polycarbonate Z.

14. A process for fabricating a flexible electrophotographic imaging member comprising providing a supporting substrate coated with at least a charge generating layer, applying a charge transport coating composition comprising a first charge transport material represented by:

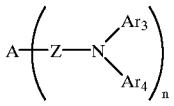

wherein n is 0 or 1, when n=0, A is selected from

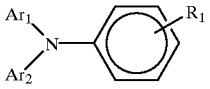

when n=1, A is selected from the group consisting of

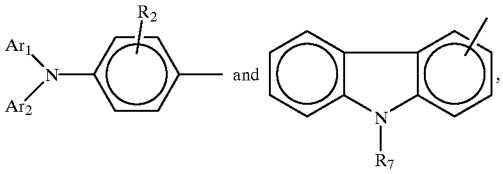

$Ar_1$ and $Ar_2$ are independently selected from:

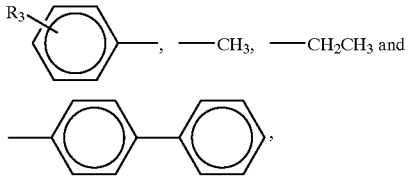

$Ar_3$ and $Ar_4$ are independently selected from the group consisting of

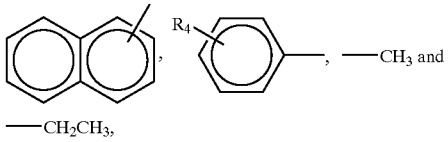

Z is selected from the group consisting of

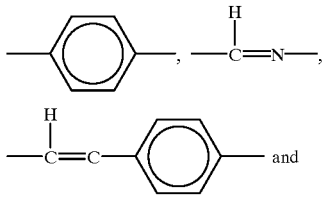

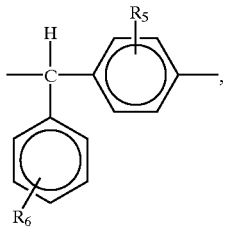

$R_{1-7}$ are independently selected from the group consisting of

—H, —$CH_3$, —$C_2H_5$, —$C(CH_3)_3$, —Cl and —$OCH_3$, and a second charge transport material represented by:

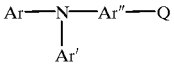

wherein:

Q is represented by the formula:

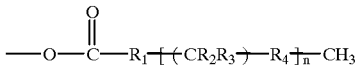

wherein:

$R_1$ and $R_4$ are independently selected from the group consisting of:

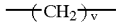

and $R_2$ and $R_3$ are independently selected from the group consisting of:

—H, —$(CH_2)_v$—$CH_3$, —$CH(CH_3)_2$ and —$C(CH_3)_3$ wherein v is 1 to 10, n is 0 to 10, and Ar" is

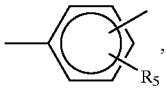

Ar is

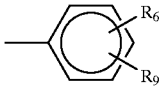

Ar' is selected from the group consisting of

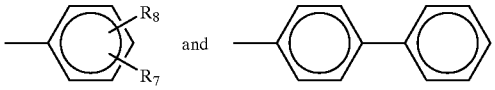

wherein $R_5$, $R_6$, $R_7$, $R_8$ and $R_9$ are independently selected from the group consisting of

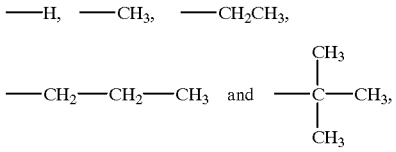

a film forming binder, a high volatility solvent and a low volatility solvent to form a coating composition layer, and drying the layer to form a charge transport layer, the charge transport layer comprising between about 37 percent and about 57 percent by weight of the first hole transport material, between about 3 percent and about 10 percent of weight of the second hole transport material, between about 60 percent and about 40 percent by weight of the film forming binder, and residual low volatility solvent.

* * * * *